United States Patent [19]

Ogata

[11] 4,144,693

[45] Mar. 20, 1979

[54] FOOD PACKAGING METHOD AND APPARATUS

[75] Inventor: Takeru Ogata, Amagasaki, Japan

[73] Assignee: Toyo Co., Ltd., Amagasaki, Japan

[21] Appl. No.: 806,673

[22] Filed: Jun. 15, 1977

[30] Foreign Application Priority Data

Jun. 16, 1976 [JP] Japan ..... 51-71446

[51] Int. Cl.[2] ..... B65B 31/00; B65B 9/08

[52] U.S. Cl. ..... 53/433; 53/450; 53/51; 53/477; 53/493; 53/552

[58] Field of Search ..... 53/180 M, 182 M, 28, 53/57, 59 R, 112 A, 22 A

[56] References Cited

U.S. PATENT DOCUMENTS

| | | | |
|---|---|---|---|
| 2,113,636 | 4/1938 | Vogt | 53/180 M X |
| 2,200,971 | 5/1940 | Sonneborn et al. | 53/180 M X |
| 2,852,898 | 9/1958 | Berg | 53/182 M |
| 2,950,588 | 8/1960 | Gausman | 53/182 M X |
| 4,023,327 | 5/1977 | Simmons | 53/180 M X |

FOREIGN PATENT DOCUMENTS

| | | | |
|---|---|---|---|
| 1406055 | 9/1975 | United Kingdom | 53/182 M |

*Primary Examiner*—Travis S. McGehee

[57] ABSTRACT

Method and apparatus for continuously and automatically packaging preferably particulate food in successive fixed amounts by using a ribbon-like film, preferably of a synthetic resin. The film is continuously payed out from a roll and is progressively wrapped around a cylindrical forming chute with the help of a plate, while longitudinally heat sealing the overlap of the opposite lateral edges of the wrapped film, to change it into a tubular form, charging the food thereinto from above the chute, heat sealing the top and bottom of a food receiving region of the tubular film, and cutting off that region from the continuous tubular film. The apparatus allows the continuous production of bags or enclosures, from the initial ribbon-like and later tubular film, charged with the food, in a simple cyclical operation.

16 Claims, 9 Drawing Figures

FOOD PACKAGING METHOD AND APPARATUS

The invention relates to a continuous food packaging method and suitable apparatus therefor, combining the preparation of bag-like enclosures from a continuous, ribbon-like film with the charging of the food and subsequent completion of the end products constituted by the enclosures.

Generally, automatic packaging of food involves making bags with their upper ends open, by a bag making machine, charging the food into the bags, and sealing the open portions. Other methods involve using a cylindrical forming chute around which the required amount of a ready-made tubular film is mounted, downwardly feeding the film in synchronism with the operation of the food charging through the chute, and heat sealing the top and bottom of a food receiving region of the tubular film, to confine the food.

In any of these methods, the formation of the bags or of the tubular film, and the charging of the food thereinto, must be performed by separate machines; hence the automatic packaging of food becomes corresponding ineffective.

A first object of the present invention is to achieve the formation of a tubular film from a ribbon-like or wider continuous film material, concurrently with the charging of the food, by using a roll of the packaging film, progressively cylindrically wrapping the film that is continuously payed out from the roll around a forming chute with the help of a plate, and longitudinally heat sealing the overlap of the opposite lateral edges of the wrapped film, to finish it into a tubular form.

Since the formation of the bags from the film and the charging of the food into the bags can be performed at a stroke by a single machine, the present invention has the merit and advantage that more efficient automatic food packaging is achieved.

Further, in conventional apparatus that uses a ready-made tubular film, since the food is fed through the interior of the forming chute, it is necessary to mount a predetermined amount of the tubular film concentrically around the outer peripheral surface of the chute in advance, successively to pay out the film in fixed amounts and in a downward direction, each amount corresponding to a single bag, as the food packaging operation proceeds. Therefore, the amount of the tubular film that can be mounted about the chute is limited, and each time the film is used up, the apparatus has to be stopped to mount another batch of film on the chute. This is very inefficient.

A second object of the invention is to eliminate the above-described disadvantages inherent in conventional apparatus, by using a roll of ribbon-like or similar packaging film in such a manner that the film is continuously payed out from the roll and is fed to the chute, and is progressively wrapped around the latter with the help of a forming plate.

According to the invention, the diameter of the film roll, that is the amount of the film can be made sufficiently large so as substantially to prolong the operating time, and hence the amount of food which can be packaged by using a single roll of film can be greatly increased.

Further according to the invention, after the tubular film is downwardly fed by roll means, in synchronism with the operation of charging the food through the chute, when a pair of parallel heat seals, for bag bottom and top, are formed on the film at places above a food receiving region, the feed roll means are synchronously driven to downwardly inch the film. Therefore, even if heat sealing is applied to the film, tensioned under the weight of the food, there is no danger of the film being broken owing to a tension acting on the welds or seals, so that mispackaging can be avoided.

Further, according to the invention, since a pair of upper and lower, parallel heat seals is formed on the film above the food receiving region, the sealing of the top of a portion having the food already received therein, and of the bag bottom of another film portion, for subsequently receiving food, are effected in a single operation of a transverse heat sealing means, thereby reducing the number of steps for the automatic food packaging. This increases the packaging rate.

Further, concurrently with the formation of the pair of heat seals, the film is cut between the two heat seals. Thus, since the cutting off of the product from the film is concurrent with the heat sealing operation, the automatic food packaging rate is further improved.

It should be understood that the inventive method is not limited to the exemplary apparatus described and illustrated herein, and that other arrangements, means and modified steps can be used.

Further objects, features, advantages and particulars of the inventive method and apparatus will become better understood from the following description when considered with the accompanying drawings, wherein FIG. 1 is a front elevation of an exemplary, preferred food packaging apparatus according to the invention;

Figure 1:
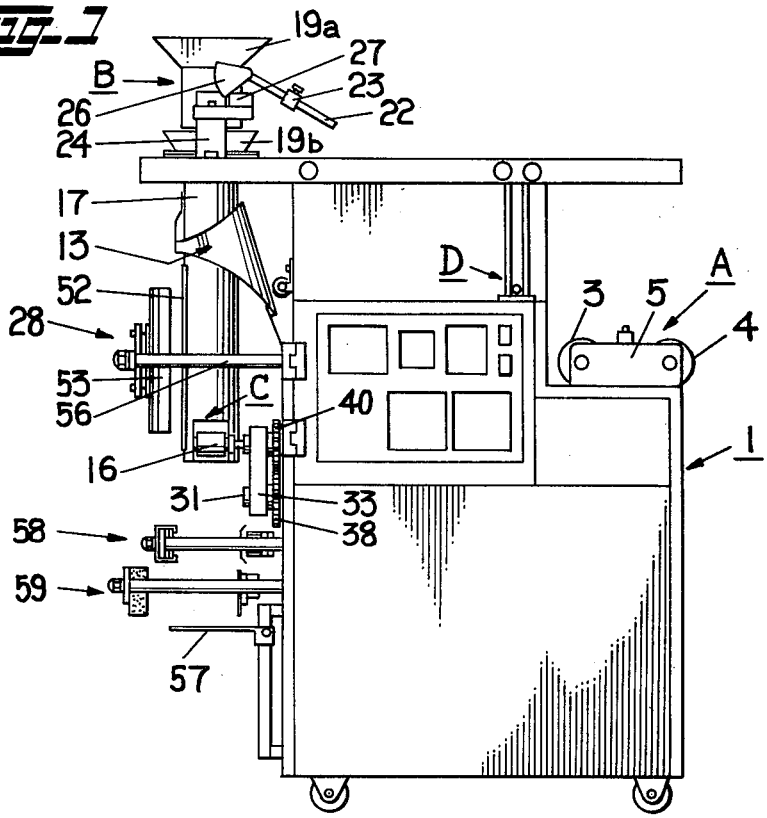
Figure 4:
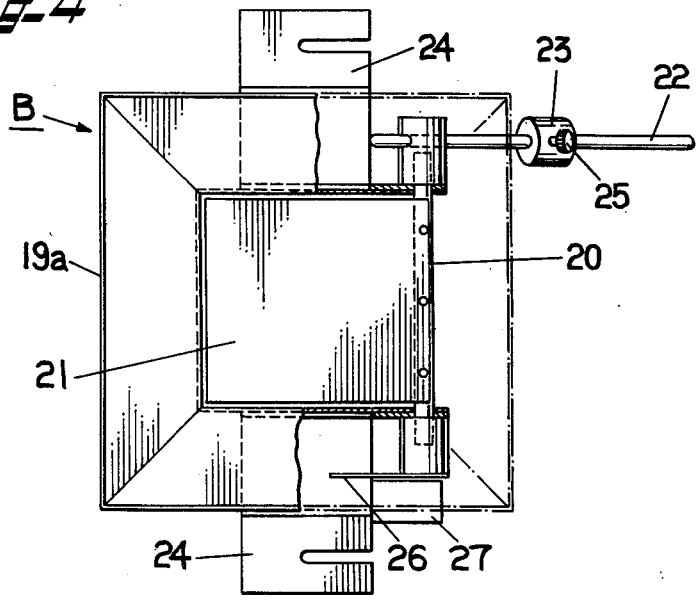
FIG. 4 is a partly broken away enlarged plan view of a hopper device in the apparatus.
Figure 2:
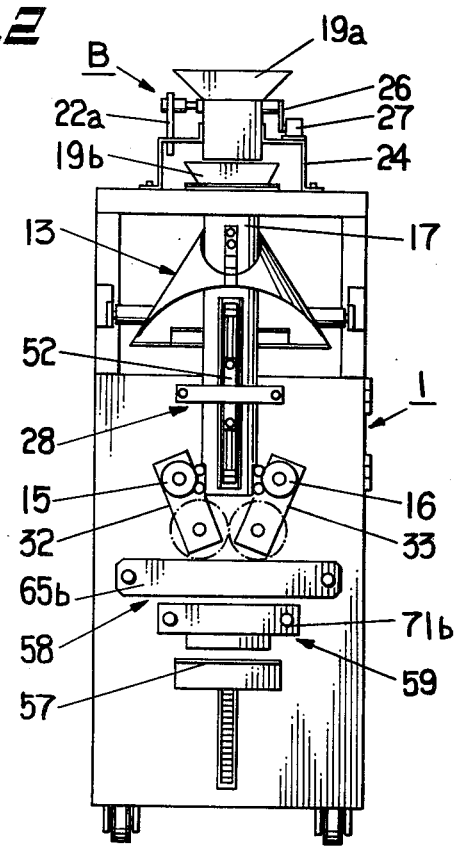
FIG. 2 is a side view of the apparatus of FIG. 1.
Figure 5:
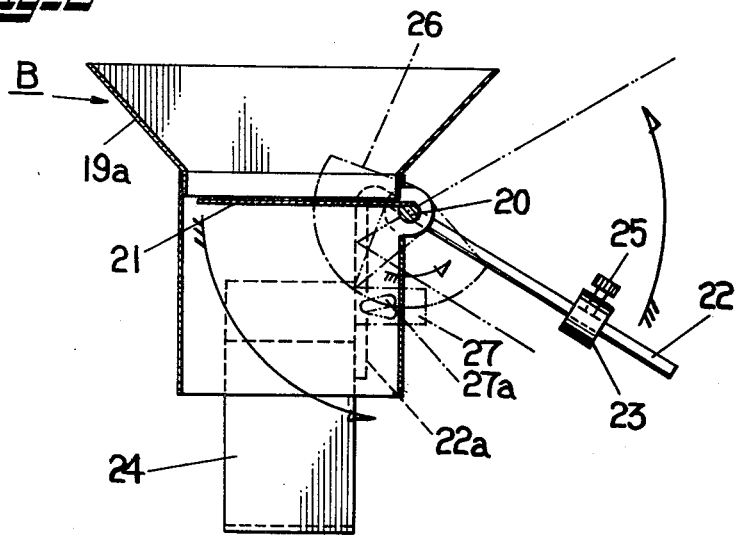
FIG. 5 is a side view, in a vertical section, of the hopper device of FIG. 4.
Figure 3:
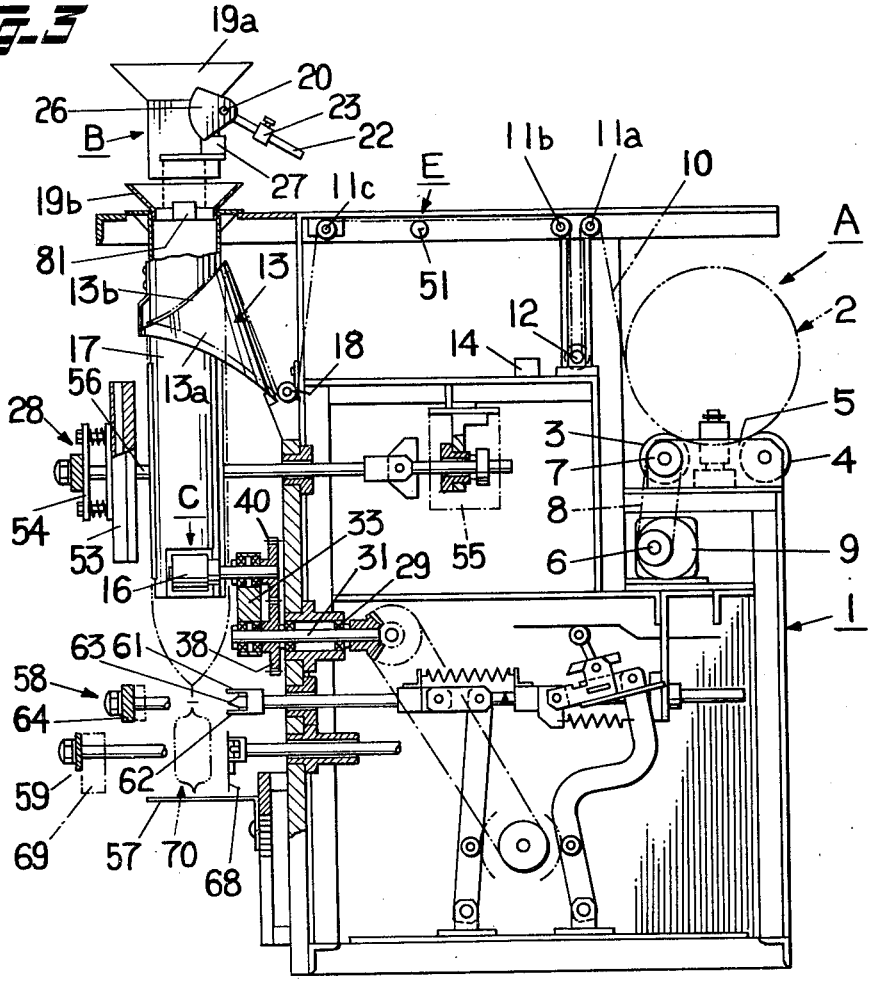
FIG. 3 is an enlarged vertical sectional view showing the internal arrangement of the apparatus.

Referring to the drawings, and particularly to FIGS. 1 and 3, film supplying means, generally designated at A, include support rolls 3, 4 journaled between a pair of brackets 5 on one side of a body 1 in the upper part of the apparatus, the rolls supporting a roll 2 of ribbon-like or wider packaging film 10 (omitted from FIG. 1).

One roll, 3, is rotated by a motor 9, movement being transmitted through pulleys 6, 7 and a belt 8, whereby the roll 2 of film is rotated to progressively pay out the film 10. The film travels to a forming plate 13 via guide rollers 11*a*, 11*b*, 11*c* and a dancer roller 12 which latter is part of a unit D to be described later. The functions of the latter roller and of a microswitch 14, adapted to be turned on and off by the roller 12, have close connection with the function of feed rolls 15, 16 also to be described later.

Figure 6:
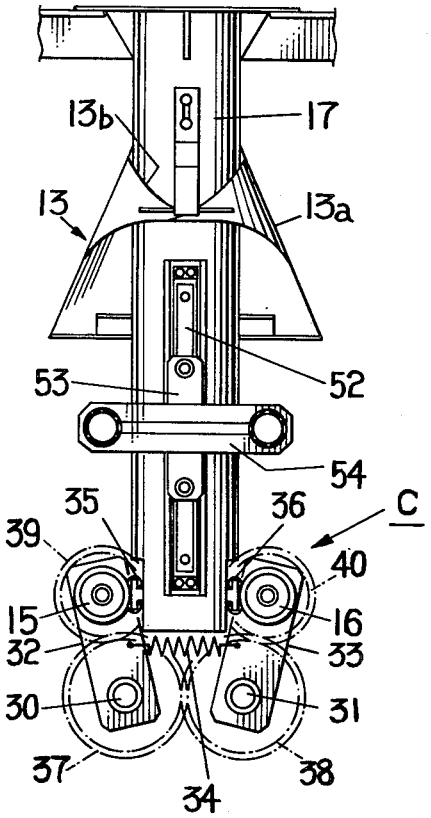
FIG. 6 is an enlarged front view of a forming chute in the apparatus, viewed from the left-hand side of FIGS. 1 and 3.

The forming plate 13 is disposed outside a cylindrical forming chute 17 to surround the latter so that the film 10, having its direction of travel reversed by a roller 18, can be wrapped around the outer surface of the chute 17. The forming plate 13, as shown in FIG. 6, consists of a skirt plate 13*a* obliquely disposed outside the forming chute 17. The upper surface of the skirt plate, which is a slide surface for the film 10, is gradually curved in such a manner that, as it approaches the forming chute 17, its curvature approaches the curvature of the outer surface of the chute. The upper end portion of the skirt is fitted on the chute with a small annular clearance 13*b* defined therebetween to allow the film 10 to pass therethrough. As the film travels, sliding on the skirt plate 13*a* after passing around the roller 18, it is progressively cylindrically curved. The film passing through the clearance 13*b* is wrapped around the chute 17.

In FIGS. 1 to 5, a hopper device is designated B above the chute 17. The device includes upper and lower hoppers 19*a*, 19*b*. Disposed inside the upper hopper 19*a* is a shutter plate 21 rotatable around a horizontal shaft 20 through 90° between horizontal and vertical positions. Fixed on one end of a shaft 20, and projecting outside the hopper 19*a*, is a balance arm 22 having a weight 23 slidably fitted thereon. The shutter plate 21 is normally in its horizontal position in that one end 22*a* of the arm 22 abuts against a stop 24; when a predetermined amount of food accumulates on the plate 21, the latter is downwardly turned against the weight 23 to allow the food to be charged into the chute 17 through the lower hopper 19*b*. This means that a food measuring action is constituted by the shutter plate 21 and the balance weight 23. Thus, the setting of amounts to be measured out is determined by the position of the weight 23 on the arm 22. A screw 25 is provided for fixing the weight 23 along the arm 22 (see FIGS. 4 and 5).

Further, the other end of the shaft 20 has a sector cam plate 26 fixed thereon, and a microswitch 27 is mounted on the outer wall surface of the upper hopper 19*a*, associated with the plate 26. As the plate 21 is downwardly turned, the plate 26 kicks an actuator 27*a* of the microswitch 27 to turn the same whereby two timers, not shown, are activated. The first timer is used for driving a vertical heat sealing means 28 while the second timer is used for driving the feed rolls 15, 16.

In addition, in the hopper device B, it is possible to use only the lower hopper 19*b*, the upper hopper being then omitted. The upper hopper 19*a* also serves as measuring means, as described above, and it is needed when food is to be charged into the chute 17 while measuring the same. However, when pre-measured amounts of the food are to be charged successively into the chute 17, it is only necessary to use the lower hopper 19*b*.

In that case, as shown in FIG. 3, a microswitch 81 may be installed inside the lower hopper 19*b* for detecting the passage of food. Such a microswitch may, of course, be replaced by a photo-electric switch and the like. Such a switch 81 can be connected to the two timers that were described earlier.

Below the chute 17, a pair of parallel shaft 30, 31 (see FIG. 6) is supported by the body 1 through bearings 29 for rotation only. Roll support blocks 32, 33 are rotatably supported on projecting ends of the shafts 30, 31, and have the feed rolls 15, 16 journaled at their free ends.

These feed rolls are located at the lower end of the chute 17 on opposite sides thereof and, as shown in FIG. 6, they are urged toward the chute 17 by the resilient force of a spring member 34 interposed between the blocks 32 and 33. Under this force, the rolls are pressed against small rolls 35, 36 supported on opposite sides of the chute 17. The film 10 is nipped between the rolls 15, 16 and the small rolls 35, 36, and it is downwardly transferred when the rolls 15, 16 are driven, as will be described later.

The feed rolls 15, 16 and the small rolls 35, 36 constitute downward film feeding means C (FIGS. 3 and 6). The shafts 30, 31 have meshing gears 37, 38 fixed thereon while gears 39, 40, meshing with the gears 37, 38, respectively, are integrally fixed to the rolls 15, 16. By imparting a turning force to one of the rotary shafts 30, 31, the feed rolls 15, 16 are rotated.

Figure 9:
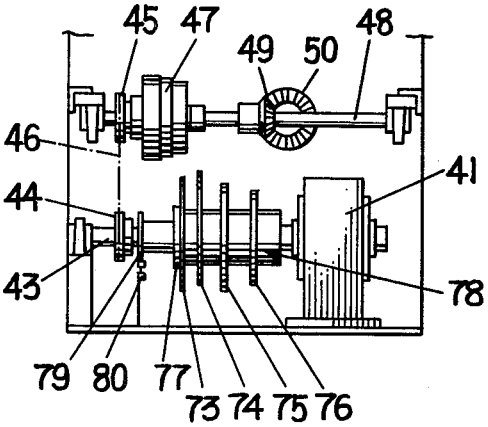
FIG. 9 is a side view showing a torque transmitting mechanism, in an illustration that can be related to that of FIG. 7.

A driving mechanism for the feed rolls will now be described. As shown in FIG. 9, it is so arranged that the turning force of a motor 42 (FIG. 7) is transmitted to the input side of a magnetic clutch 47 through an output shaft 43 of a speed reducer 41, sprockets 44, 45 and a chain 46. Upon engagement of the clutch 47, a shaft 48 is rotated and the turning force of the shaft is transmitted to the shaft 31 through bevel gears 49, 50. The clutch 47 is actuated by the previously described second timer with some time lag after the microswitch 27 is turned on, whereby the feed rolls 15, 16 are rotated, and hence the film 10 wrapped around the forming chute 17 is fed downwardly by an amount corresponding to the length of one bag to be made by the apparatus.

FIG. 3 shows means, generally designated by E, for detecting the amount of feed of the film 10, corresponding to one bag length, and it includes a photo-electric switch 51 that detects sense marks printed on the film 10 at intervals of one bag length, the resulting detection signal causing the disengagement of the clutch 47. Thus, the amount of each feed of the film corresponds to the distance between consecutive sense marks.

In order to assure the film feed by the rolls 15, 16, tension means D (FIG. 1) are provided for imparting a suitable tension to the film 10. This means D includes the previously described dancer roller 12. This roller is placed against the film 10, between the rollers 11*a*, 11*b*, its weight being utilized to pull the film 10 downwardly, thereby imparting tension thereto.

Further, during the operation of the inventive packaging apparatus, if the timing for intermittent feed of the film by the rolls 15, 16 happens to fail to agree with the rate of film feed from the roll 2, so that overfeed occurs, then the roller 12 falls to its lowermost position, thereby kicking the actuator of the microswitch 14 to turn off the latter and stop the motor 9. By this the film delivery is stopped. As the film feeding operation of the rolls 15, 16 continues while the motor 9 is at rest, to the extent that the roller 12 rises and leaves the microswitch 14, the motor 9 is re-started.

The vertical heat sealing means 28 is disposed between the forming plate 13 and the rolls 15, 16 and is associated with the chute 17. More particularly, a heat sealing block 52 (FIG. 6) made of a heat-resistant material is secured to the outer surface of the chute 17 by set screws, while a vertically extending heating plate 53 is secured to a support bar 54. After the lapse of time set by the first timer, activated by the microswitch 27, a solenoid 55 (FIG. 3) is energized to withdraw a rod 56, whereby the plate 53 is brought into intimate contact with the block 52, to carry out a predetermined vertical heat sealing.

The overlap of the opposite lateral edges of the film 10, wrapped around the chute 17 with the help of the forming plate 13, is positioned on the block 52, and heat sealing is now applied to the overlap, thus forming the film into a tubular or bag-shaped form.

Figure 7:
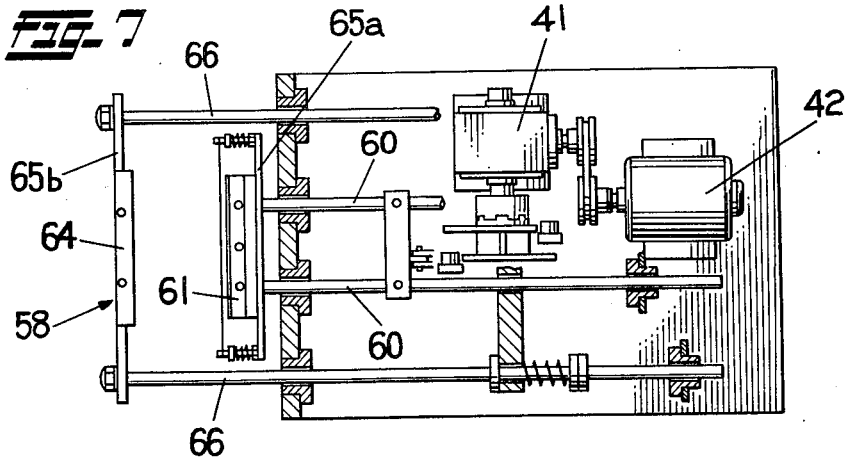
FIG. 7 is a horizontal section of a transverse heat sealing device.

A receiver table 57 is fixed at a position about two film-bag lengths below the lower end of the chute 17, and transverse heat sealing means 58 and product discharging means 59 are installed between the chute 17 and the table 57. The heat sealing means 58, as shown in FIGS. 3 and 7, includes a pair of transversely extending upper and lower heating plates 61, 62 and a cutter 63 disposed therebetween, which are fixed to the front ends of rods 60, and a transversely extending heat sealing block 64 associated therewith. The arrangement is such that their relative movement, toward each other, results in forming a pair of upper and lower heat seals on the film 10, and also in cutting the film between the heat seals.

In FIG. 7, a support bar is designated at 65*a* for the heating plates 61, 62 and the cutter 63; at 65*b*, a support bar is shown for the block 64; and 66 designates rods serving to guide the bar 65*b*.

Figure 8:
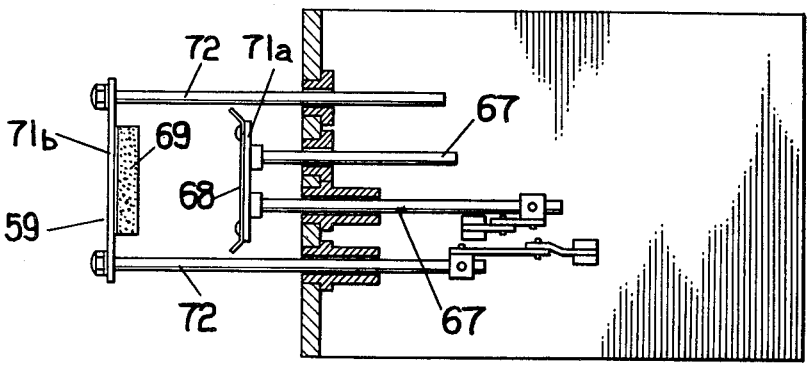
FIG. 8 is a similar section of a degassing or air removing device.

The product discharging means 59 of FIGS. 3 and 8 includes a push or discharge plate 68 secured to the front ends of rods 67 by set screws, and a clamping body 69 made of an elastic material, such as sponge, is associated therewith. The arrangement is such that relative movement of them results in clamping the film 10 to allow the air therein to escape upwardly, a packed product 70 being then discharged from the table 57 in the form of a properly sealed and completed bag, filled with the food product being processed, as will be understood from the subsequent operational description. At 71*a*, a support bar is shown for the plate 68; 71*b* is a support bar for the clamping body 69; and 72 designates rods serving to guide the bar 71*b*.

The driving of the transverse heat sealing means 58 and of the product discharging means 59 is effected by cam plates. Thus, referring to FIG. 9, a cylindrical cam unit 77 having cam plates 73 to 76 fixed thereon is fitted on the speed-reducer output shaft 43, and a magnetic clutch 78 is installed between the cam unit 77 and the shaft 43, adapted to be engaged when the microswitch 27 is turned on, thereby driving the unit 77.

The cam plates 73, 74 are associated with the discharging means 59 and have levers (not shown) pressed thereagainst so that they are swung as the plates 73, 74 are rotated, thereby initiating relative movement of the plate 68 and the body 69 toward each other for degassing or air removal, followed by relative movement thereof away from each other, whereupon the push plate 68 is advanced by itself so that the packed product 70 on the receiver table 57 is discharged.

The cam plates 75, 76 are in turn associated with the transverse heat sealing means 58 and are so arranged that, just after air removal by the discharging means 59 and prior to the discharging operation, predetermined heat sealing and cutting are effected. As for the application of heat sealing to the overlap of the opposite lateral film edges by the vertical (longitudinal) heat sealing means 28, the time-delay action of the first timer may be set so that heat sealing is effected during the time the film 10 is stationary between the air-removing and the discharging operations.

Designated at 79 is a cam plate integral with the cam unit 77, adapted so that when the transverse heat sealing means 58 is actuated, it actuates a microswitch 80 to energize the clutch 47 for a very short time to rotate the rolls 15, 16, thereby inching the film 10. This drive is necessary in that if heat sealing is applied to the film, tensioned under the weight of the food received therein, there would be fear of the film being broken. Thus, the inching drive of the film serves to relieve any possible tension.

In operation, food is continuously supplied to the hopper to accumulate on the plate 21, during which time the overlap of the opposite lateral film edges, wrapped around the chute 17, is heat sealed by the longitudinal heat sealing means 28, to convert the film into the tubular form. It is to be understood that the lower end of the film has already been heat sealed by the transverse heat sealing means 58 during the idle running of the packaging apparatus and hence the lower end is already closed.

When the amount of food accumulating on the plate 21 reaches a predetermined weight, as set by the balance weight 23, the plate 21 is downwardly turned to charge the food into the chute 17. The microswitch 27, which was concurrently turned on, activates both timers. The second timer functions so that, with a sufficient time lag, it allows the food to fall to the lower end of the film, the clutches 47, 78 being engaged to rotate the rolls 15, 16 and the cam unit 77. The rolls 15, 16 feed the film 10 by the amount corresponding to one bag length, and as soon as the lower end of the film reaches the top of the table 57, the photo-electric switch 51 (FIG. 3) detects the sense mark on the film and creates a signal to cause the disengagement of the clutch 47 (FIG. 9), with the result that turning force is no longer transmitted to the shaft 48, connected to the shaft 31, thereby stopping the feed rolls 15, 16.

Further, the rotating cam unit 77 actuates the product discharging means 59, causing the body 69 and the plate 68 to clamp the food receiving region of the film for air removal. Just after this operation, the transverse heat sealing means 58 is actuated to seal and cut the upper part of that film region.

When the transverse heat sealing means 58 is thus actuated, the microswitch 80 is actuated so that the clutch 47, which has been disengaged by the signal from the switch 51, is engaged for a very short time to effect the inching of the film by the rolls 15, 16. In this way, the food is packaged to provide the product 70 which is discharged from the table 57 by the forward movement of the plate 68, whereupon the heat sealing means 58 and the discharging means 59 are restored to their original positions.

Of the pair of upper and lower heat seals provided by the transverse heat sealing means 58, the lower one serves to close the upper portion of the product, while the upper seal serves to close the bag bottom of the product to be subsequently obtained. Further, by the action of the first timer, the vertical heat sealing means 28 is actuated to act on the next film portion between the air-removal and the product discharging times. By repetition of these operations, continuous automatic food packaging is carried out.

It will be understood by those skilled in the art that several modifications of and additions to or changes in the details of the described apparatus can be made, without departing from the spirit and scope of the invention. Similarly, the described procedural steps of the new packaging method can be modified, supplemented or combined, as necessary, without affecting the basic inventive features disclosed hereinabove.

What I claim is:

1. A method of packaging particulate food into tubular bag-shaped enclosures formed during the performance of the method, comprising the steps of: paying out a ribbon-like, continuous film; transferring the same to forming means; imparting limited tension to the film; progressively cylindrically wrapping the continuous film about chute means for the food; vertically heat sealing an overlap on opposite lateral edges of the wrapped film, thereby finishing it into a still continuous but tubular form; downwardly feeding the tubular film, substantially concurrently with feeding and filling the food into a food receiving region of the tubular film; forming a pair of transverse heat seals on the tubular film above the region; downwardly inching the tubular film in synchronism with said transverse heat-seal forming step; and substantially simultaneously cutting the filled tubular film between the seals to form an end product constituted by the bag-shaped enclosure filled with the food.

2. The food packaging method as defined in claim 1, wherein said vertical heat-sealing step is effected after said transverse heat-seal forming step.

3. The food packaging method as defined in claim 1, further comprising the step of removing air from the filled tubular film before said transverse heat-seal forming and said cutting steps.

4. The food packaging method as defined in claim 3, wherein said air-removing step is performed by clamping the filled tubular film.

5. The food packaging method as defined in claim 4, further comprising the step of successively discharging the end product after said cutting step.

6. An apparatus for packaging particulate food into tubular, bag-shaped enclosures formed by the apparatus, comprising, in combination: means (A) for supplying a ribbon-like continuous film (10) from a roll (2); a chute (17) for the food and having a substantially cylindrical outer forming surface for the film; a forming plate (13) at least partly surrounding said chute and constituting means for wrapping the continuous film about said forming surface; means (D) for tensioning the film, disposed between said supplying means and said forming plate; means for determining desired lengths of the film, which will constitute the bag-shaped enclosures; means (E) in the path of film travel for detecting predetermined successive enclosure lengths of the film; hopper means (B) including means for detecting the charging of the food into said chute; first, vertical heat sealing means (28) disposed substantially midway of the height of said chute, to act on an overlap on opposite lateral edges of the wrapped film, thereby finishing it into a still continuous but tubular form; roll means (C), installed outside the lower end of said chute, for downwardly feeding the tubular film by one enclosure length; means for filling the food into a receiving region of the tubular film; second heat sealing means (58) below said lower end of the chute, to form a pair of transverse heat seals on the tubular film above the region, to constitute respective top and bottom seals for a presently and a subsequently processed enclosure; means (63) for cutting the filled tubular film between the seals to form an end product (70) constituted by the bag-shaped enclosure filled with the food; and means (59) for discharging the end product after the operation of said cutting means from a receiving table (57) substantially vertically aligned with and disposed below said second heat sealing means.

7. The food packaging apparatus as defined in claim 6, wherein said discharging means (59) includes a pair of relatively movable support bars **(71*a*, 71*b*) that constitute a gap through whichthe food receiving region of the tubular film passes, one (71*a*) of said bars carrying a push plate (68) while the other (71*b*) caries a resilient clamping body (69), the relative movement of said bars constituting means for removing air from the food receiving region before the operation of said second heat sealing means (58), said push plate performing during its forward movement the discharging of the end product (70) from said receiving table (57)**.

8. The food packaging apparatus as defined in claim 6, wherein said supplying means (A) includes a pair of support rolls (3, 4) for the roll (2) of film (10), one (3) of said rolls being driven (9) so as to cause the film roll to be rotated to pay out the continuous film.

9. The food packaging apparatus as defined in claim 6, wherein said tensioning means (D) includes a pair of substantially parallel guide rolls **(11*a*, 11*b*), a dancer roller (12) resting on a portion of the film (10) passing between said guide rolls, and switch means (14)** for detecting the descent of said dancer roller to its lowermost position when there is overfeed of the film, for controlling the operation of said supplying means (A).

10. The food packaging apparatus as defined in claim 9, further comprising means whereby said switch means (14) at least temporarily stops said supplying means (A) when said dancer roll (12) is at the lowermost position.

11. The food packaging apparatus as defined in claim 6, wherein the ribbon-like continuous film (10) used in the apparatus has substantially equidistant marks therealong, corresponding to the successive enclosure lengths, and said length detecting means (E) includes electrical means (51) for successively sensing the marks.

12. The food packaging apparatus as defined in claim 6, wherein said forming plate (13) consists of a skirt plate **(13*a*) obliquely disposed outside said chute (17), the upper surface of said skirt plate constituting a slide surface for the film (10) and being gradually curved such that it approaches the contours of said outer surface of the chute, and the upper end of said skirt plate defines a small clearance (13*b*)** with said chute for the passage of the film.

13. The food packaging apparatus as defined in claim 6, wherein said first heat sealing means (28) includes a sealing block (52) secured to said outer surface of the chute (17), a heating plate (53) mounted on said block and being movable with respect thereto, and solenoid means (55) for bringing said heating plate into operative contact with said block.

14. The food packaging apparatus as defined in claim 6, wherein said second heat sealing means (58) includes a pair of support bars **(65*a*, 65*b*) that are relatively movable, the film (10) passing between them, one (65*a*) of said bars carrying a pair of heating plates (61, 62), said cutting means (63) being positioned between said heating plates, while the other (65*b*) of said bars carries a sealing block (64)**.

15. An apparatus for packaging particulate food into tubular, bag-shaped enclosures formed by the apparatus, comprising, in combination: means (A) for supplying a ribbon-like continuous film (10) from a roll (2); a chute (17) for the food and having a substantially cylindrical outer forming surface for the film; a forming plate (13) at least partly surrounding said chute and constituting means for wrapping the continuous film about said forming surface; means (D) for tensioning the film, disposed between said supplying means and said forming plate; means for determining desired lengths of the film, which will constitute the bag-shaped enclosures; means (E) in the path of film travel for detecting predetermined successive enclosure lengths of the film;

hopper means (B) including means for detecting the charging of the food into said chute; first, vertical heat sealing means (28) disposed substantially midway of the height of said chute, to act on an overlap on opposite lateral edges of the wrapped film, thereby finishing it into a still continuous but tubular form; roll means (C), installed outside the lower end of said chute, for downwardly feeding the tubular film by one enclosure length; means for filling the food into a receiving region of the tubular film; second heat sealing means (58) below said lower end of the chute, to form a pair of transverse heat seals on the tubular film above the region, to constitute respective top and bottom seals for a presently and a subsequently processed enclosure; and means (63) for cutting the filled tubular film between the seals to form an end product (70) constituted by the bag-shaped enclosure filled with the food; wherein said hopper means includes a shutter plate (21) and means for urging the latter into a normal, horizontal position, but being adapted to be partly swung downward; means for retaining said shutter plate in the horizontal position until a predetermined amount of food is accumulated thereon; and switch means (27) for detecting the downward movement of said shutter plate.

16. An apparatus for packaging particulate food into tubular, bag-shaped enclosures formed by the apparatus, comprising, in combination: means (A) for supplying a ribbon-like continuous film (10) from a roll (2); a chute (17) for the food and having a substantially cylindrical outer forming surface for the film; a forming plate (13) at least partly surrounding said chute and constituting means for wrapping the continuous film about said forming surface; means (D) for tensioning the film, disposed between said supplying means and said forming plate; means for determining desired lengths of the film, which will constitute the bag-shaped enclosures; means (E) in the path of film travel for detecting predetermined successive enclosure lengths of the film; hopper means (B) including means for detecting the charging of the food into said chute; first, vertical heat sealing means (28) disposed substantially midway of the height of said chute, to act on an overlap on opposite lateral edges of the wrapped film, thereby finishing it into a still continuous but tubular form; roll means (C), installed outside the lower end of said chute, for downwardly feeding the tubular film by one enclosure length; means for filling the food into a receiving region of the tubular film; second heat sealing means (58) below said lower end of the chute, to form a pair of transverse heat seals on the tubular film above the region, to constitute respective top and bottom seals for a presently and a subsequently processed enclosure; and means (63) for cutting the filled tubular film between the seals to form an end product (70) constituted by the bag-shaped enclosure filled with the food; wherein said roll means includes small rolls (35, 36) journaled on an outer peripheral surface of said chute; feed rolls (15, 16) resiliently urged against said small rolls, for nipping the film between said small rolls and said feed rolls; and means for driving said rolls by a signal derived from said charge detecting means.

* * * * *